US009875857B2

(12) United States Patent
Schwaiger et al.

(10) Patent No.: US 9,875,857 B2
(45) Date of Patent: Jan. 23, 2018

(54) CONTACT PIN AND PIPE CONTACT, AND METHOD FOR PRODUCTION

(71) Applicant: PLANSEE POWERTECH AG, Seon (CH)

(72) Inventors: August Schwaiger, Duerrenaesch (CH); Mike Boening, Duerrenaesch (CH)

(73) Assignee: Plansee Powertech AG, Seon (CH)

( * ) Notice: Subject to any disclaimer, the term of this patent is extended or adjusted under 35 U.S.C. 154(b) by 0 days.

(21) Appl. No.: 15/116,530

(22) PCT Filed: Feb. 19, 2015

(86) PCT No.: PCT/EP2015/000368

§ 371 (c)(1),
(2) Date: Aug. 4, 2016

(87) PCT Pub. No.: WO2015/124300

PCT Pub. Date: Aug. 27, 2015

(65) Prior Publication Data

US 2016/0379765 A1 Dec. 29, 2016

(30) Foreign Application Priority Data

Feb. 21, 2014 (AT) ..... GM180/2014

(51) Int. Cl.
*H01H 1/025* (2006.01)
*H01H 1/021* (2006.01)
(Continued)

(52) U.S. Cl.
CPC ..... *H01H 1/025* (2013.01); *H01H 1/021* (2013.01); *H01H 1/385* (2013.01); *H01H 11/04* (2013.01);
(Continued)

(58) Field of Classification Search
CPC ..... H01H 11/048; H01H 11/06; H01H 1/02; H01H 1/023; H01H 1/0233; H01H 1/0237;
(Continued)

(56) References Cited

U.S. PATENT DOCUMENTS 3,752,946 A 8/1973 Bailey et al.
4,086,461 A * 4/1978 Gonek ..... H01H 33/12 218/74
(Continued)

FOREIGN PATENT DOCUMENTS

DE 1928957 A1 12/1970
DE 3736835 A1 5/1989
(Continued)

*Primary Examiner* — Truc Nguyen
(74) *Attorney, Agent, or Firm* — Laurence A. Greenberg; Werner A. Stemer; Ralph E. Locher

(57) ABSTRACT

A contact pin for a high-voltage and/or medium-voltage switch includes a contact tip of arc-erosion resistant material, a tubular support sleeve connected to the contact tip and a support core in the sleeve. The contact tip is in a forward region of the contact pin where arcs arise during use. The sleeve is in a rearward region of the contact pin, adjoining the forward region, where no arcs arise during use. A pipe contact includes an arc-erosion resistant annular contact and a support pipe connected to the annular contact. The annular contact is in a forward region of the pipe contact where arcs arise during use, and the support pipe is in a rearward region of the pipe contact, adjoining the forward region, where no arcs arise during use. Methods for producing a contact pin and a pipe contact are also provided.

18 Claims, 2 Drawing Sheets

(51) Int. Cl.
*H01H 1/38* (2006.01)
*H01H 11/04* (2006.01)

(52) U.S. Cl.
CPC ..... *H01H 11/041* (2013.01); *H01H 11/042* (2013.01); *H01H 11/043* (2013.01)

(58) Field of Classification Search
CPC ..... H01H 1/027; H01H 1/06; H01H 1/385; H01H 2033/888; H01H 2201/008; H01H 2201/026; H01H 33/025; H01H 33/12
See application file for complete search history.

(56) References Cited

U.S. PATENT DOCUMENTS

| | | | | | |
|---|---|---|---|---|---|
| 4,393,291 | A * | 7/1983 | Stewart | H01H 33/7023 | 218/13 |
| 4,628,164 | A * | 12/1986 | Talpo | H01H 33/12 | 200/258 |
| 4,707,576 | A * | 11/1987 | Gessinger | B23K 35/302 | 200/262 |
| 6,211,478 | B1 * | 4/2001 | Schoenemann | H01H 1/021 | 218/146 |
| 2007/0246444 | A1 * | 10/2007 | Saxl | H01H 1/385 | 218/16 |

FOREIGN PATENT DOCUMENTS

| | | | |
|---|---|---|---|
| DE | 102008060971 | B3 | 7/2010 |
| DE | 102012101222 | A1 | 6/2013 |
| JP | H01248409 | A | 10/1989 |
| WO | 2010063369 | A1 | 6/2010 |

* cited by examiner

CONTACT PIN AND PIPE CONTACT, AND METHOD FOR PRODUCTION

BACKGROUND OF THE INVENTION

Field of the Invention

The invention relates to a contact pin and to a pipe contact for switches in the high-voltage sector and/or the medium-voltage sector, and to in each case one method for producing a contact pin and a pipe contact.

DE 10 2008 060 971 B3 discloses a contact part for a high-voltage switch. A contact element of an arc resistant material is fastened to a main body. The main body may be configured as a pin or as a hollow pin or a pipe, respectively. In order to protect the main body from arc erosion, the external side of the main body in a region adjoining the contact element is covered in an arc resistant or arc-erosion resistant protective layer, respectively.

BRIEF SUMMARY OF THE INVENTION

It is an object of the invention to provide a contact pin and a pipe contact which are simple and cost-effective to produce.

This object is achieved by the features of the contact pin for a high-voltage switch and/or medium-voltage switch, the method for producing a contact pin, the pipe contact for receiving a contact pin and the method for producing a pipe contact, according to the invention.

Advantageous design embodiments are the subject matter of the dependent claims.

According to the invention, a contact pin for a switch in the high-voltage sector and/or the medium-voltage sector is provided. The contact pin is preferably conceived for switching voltages in a range from approx. 12 kV to approx. 1200 kV. When used in a (high-voltage) switch, the contact pin engages in an opening of a pipe contact, so as to close a switch contact, such that electricity is conducted by way of the contact pin and the pipe contact. Arcs which may lead to arc erosion on the contact pin and on the pipe contact are created by the high voltages applied when the switch contact is being closed (and opened).

The contact pin has a contact tip of a contact erosion resistant or arc resistant material, respectively, so as to prevent such erosion. For example, the contact tip may be produced from a refractory metal or from an alloy based on a refractory metal, such that said contact tip resists the arcs and the high temperatures which arise therewith. A refractory metal refers to a metal which has a melting point of 1772° or higher (the former corresponding to the melting point of platinum). In as far as not otherwise defined, an alloy based on an element X in the context of this invention is understood to be an alloy which has a content of X of >50% by atomic weight. Tungsten which is infiltrated by copper, in particular having a copper proportion in terms of mass between 10 and 40% by weight, particularly preferably 20% by weight (WCu 80/20), may preferably be used.

The contact pin furthermore has a tubular support sleeve which is connected to the contact tip. The connection is preferably performed by back-casting. Alternative connection techniques are welding and brazing/soldering. A support core is configured or disposed in the support sleeve, respectively, such that the support sleeve collectively with the support core configures a contact support for the contact element. Preferably, the support core extends across the entire length of the support sleeve (in the axial direction of the contact pin), and/or the support core fills the (internal) volume of the support sleeve.

The support sleeve and the support core are preferably interconnected in a materially integral (metallurgically bonded) manner, so as to provide a stable connection between the two elements. Particularly preferably, the support core is integrally cast in the support sleeve. Incorporating the support core in the support sleeve, connecting the support core to the support sleeve, connecting the support core to the contact tip, and connecting the support sleeve to the contact tip herein is preferably performed by a back-casting procedure. According to one alternative and preferred design embodiment, the support core may be press-fitted into the support sleeve by means of a hot isostatic pressing procedure. Furthermore preferably, the support core may be provided as a prefabricated element which is plug-fitted or incorporated, respectively, in the sleeve (prior to the support sleeve being connected to the contact tip, or thereafter).

The support sleeve laterally encloses the support core, forming the external side of the contact support which directly adjoins the contact tip. The contact tip is disposed in a forward region of the contact pin in which arcs arise during use or upon switching. The support sleeve is disposed in a rear region of the contact pin, adjoining the forward region, in which no arcs arise during use.

Since the support sleeve is outside the region of the contact pin in which arcs may arise, the requirements set for the sleeve material (such as arc resistance, arc-erosion resistance, and temperature resistance, for example) are lower than in the case of the contact-tip material which may be produced from WCu 80/20, for example, as has been described above. For example, a more cost-effective material may be used for the support sleeve, the overall costs of the contact pin being reduced on account thereof. A cost-intensive coating of the contact pin using arc-resistant material, as is described in DE 10 2008 060 971 B3 is also not required.

Moreover, the contact pin described above may be produced in a simple and cost-effective manner. Herein, the contact tip (for example a solid cylinder which is easy to produce) in a back-casting process (preferably using copper) as has been described above is connected to the tubular support sleeve (for example a prefabricated pipe). However, the support sleeve may also be welded or brazed/soldered to the contact tip, for example. The contact pin is stabilized, and the support sleeve and the support core are connected to the contact tip, respectively, by integrally casting the support core in the support sleeve. This design embodiment is particularly advantageous since by virtue of integral casting the integrally cast material (such as copper, for example) has a coarse-grain microstructure, on account of which in turn the electrical and thermal conductivity of the material, and thus the conductivity of the support core, are enhanced. The support sleeve is configured so as to be tubular, that is to say that the support sleeve is open at two mutually opposite ends, or in the axial direction has open sleeve ends, respectively. On account thereof, the core material which is integrally cast in the sleeve is in direct contact with the contact tip, on account of which a stable connection between the core and the contact tip is additionally provided.

The support core is preferably produced from a material having good electrical conductivity. The support core is preferably produced from copper or aluminum, or from an alloy based on copper and/or aluminum. The support core is particularly preferably produced from copper. In this way, the entire cross section of the contact pin is used for conducting electricity. Particularly preferably, the support core has higher electrical conductivity than the support sleeve, such that the contact pin in the region of the contact support has good electrical conductivity. For example, the core material is selected from: Cu, a Cu alloy (for example CuCr1Zr), Al, and steel.

The support sleeve is preferably produced from a material which is heat resistant (for example up to 1000° C.) and is resistant to hot gases (causing heat on the reverse side). For example, when the contact pin is used in a high-voltage switch having an insulating gas (for example sulfur hexafluoride 'SF6'), the sleeve material is configured to resist the hot insulating gases which are created during switching. For example, molybdenum or tungsten may be used as a sleeve material, or an alloy based on molybdenum or tungsten having a proportion in terms of mass of 90% by weight or more of tungsten, or 90% by weight or more of molybdenum, respectively. Furthermore preferably, tungsten/copper having a proportion of copper in terms of mass between 10 and 40% by weight, for example WCu 80/20 (Cu: 20% by weight) may be used. According to one further preferred alternative, steel may be used as a support-sleeve material, on account of which a particularly cost-effective alternative is provided. When a comparatively 'soft' core material such as copper, for example, is used, the support sleeve reinforces or stabilizes, respectively, the support core or the contact pin, respectively.

Dissimilar materials or identical materials may be used for the contact tip and the support sleeve. Even when an identical material is used for the contact tip and the sleeve, production of the contact pin by way of connecting the two individual elements of contact pin and sleeve is simpler and more cost-effective than for example providing only one (cylindrical) element which is bored such that a tip of solid material remains, having a (bored) hollow cylinder which directly adjoins the former. In this case, boring waste which is complex to recycle is accumulated in particular.

The sleeve material particularly preferably is of lesser density than the contact-tip material. The weight of the contact pin may be reduced on account thereof. Contact pins (and pipe contacts) and switch contacts of high-voltage switches, respectively, are closed and opened by means of drives. A lighter weight of the contact pin means less stress on the drive, and more cost-effective drives having less output may be used, respectively. For example, the contact tip is produced from WCu 80/20 (15.2 g/cm$^3$), and the support sleeve is produced from molybdenum (10.2 g/m$^3$) or from MoCu 80/20 (9.94 g/cm$^3$), a weight saving of 17 to 20% resulting on account thereof. Additionally or alternatively, the core material preferably is of lesser density than the sleeve material, so as to further reduce the weight of the contact pin.

The wall thickness of the support sleeve, that is to say the difference between the external diameter and the internal diameter of the sleeve, is preferably in a range between 5% and 25% of the external radius of the support sleeve. On account thereof, the contact pin is stabilized and is protected against erosion by hot gases. For example, the diameter of the support sleeve (of the contact support) is approx. 20 mm, and the wall thickness of the support sleeve is approx. 1.5 mm (7.5%).

Preferably, the length/extent of the contact tip in the axial direction of the contact pin is selected such that arcs which arise during use of the contact pin, as has been described above, are limited to the contact tip, or that arcs which arise do not impact on the contact support or the support sleeve, respectively. The length ratio between the contact tip and the support sleeve, in the axial direction of the contact pin, is preferably between 1:7 and up to 1:5. For example, the contact tip (in the axial direction or the movement direction of the contact pin, respectively), has a length of approx. 24 mm, and the support sleeve or the contact support, respectively, has an axial length of approx. 130 mm. The axial length of the contact tip is particularly preferably greater than 20 mm.

The support sleeve is preferably produced from a sheet-metal material which is bent to form a sleeve (pipe) such that two mutually opposite edges of the sheet-metal panel bear on one another. The edges are subsequently welded to one another so as to provide the tubular support sleeve. Alternatively, a seamless (ready-made) pipe which is produced by extrusion molding or extrusion casting, for example, may be used as a support sleeve.

According to the invention, a pipe contact for a high-voltage and/or medium-voltage switch which is configured for receiving a contact pin as has been described above so as to close a switching contact between the contact pin and the pipe contact is provided. The pipe contact has an arc resistant or arc-erosion resistant annular contact, respectively, and a support pipe which is connected to the annular contact.

The annular contact is disposed in a forward region of the pipe contact in which arcs may arise during use in a switch. The support pipe is disposed in a rear region of the pipe contact, adjoining the forward region, in which no arcs arise during use, or is disposed outside the region in which arcs may arise, respectively. The same materials as have been described above with reference to the contact tip or the support sleeve may be used for the annular contact or the support pipe, respectively.

The pipe contact may be produced in a simple manner in that an annular contact (sintered tungsten, for example) and a support pipe (sintered molybdenum, for example) are mutually aligned in an axial manner and are collectively infiltrated in a crucible with copper, for example. In one step, the two components are thus infiltrated with a material which has good electrical conductivity, such as copper, for example, and interconnected. The infiltrated part generated may subsequently be subtractively machined so as to provide the receptacle opening for a contact pin as has been described above.

The support pipe preferably has a lesser wall thickness than the annular contact, wherein the support pipe has the same or substantially the same internal diameter as the annular contact. Once both elements have been mutually aligned in an axial manner and infiltrated (with copper), the infiltrated part may be machined such that a respective copper layer which guarantees good electrical conductivity of the pipe contact remains on the external side of the support pipe. The support pipe on the internal side of the pipe contact is exposed after machining of the pipe contact such that the pipe contact in this region is protected from hot gases and high temperatures which arise when arcs are created, as has been described above with reference to the contact pin.

In order for an external face of the pipe contact to be protected from the influence of hot gases and high temperatures, the support pipe alternatively, at a lesser wall thickness, has the same external diameter as the annular contact. After both elements have been infiltrated and subtractively post-machined, the support pipe on the external side is exposed, a layer of the infiltrated material (for example copper) remaining on the internal side of the support pipe, on account of which in turn good electrical conductivity of the pipe contact is guaranteed.

BRIEF DESCRIPTION OF THE SEVERAL VIEWS OF THE DRAWING

Exemplary embodiments of the invention will be explained in more detail by means of the figures in which.

DESCRIPTION OF THE INVENTION

Figure 1A:
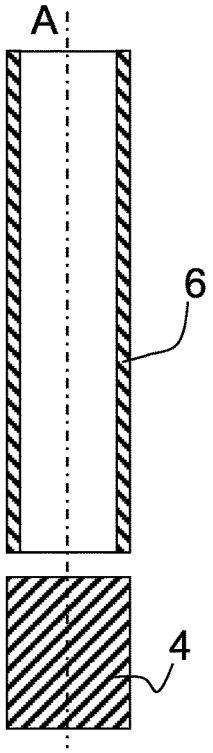
FIGS. 1*a-c* show schematic illustrations of the individual components of a contact pin before and after assembly, in a sectional side view.
Figure 1B:
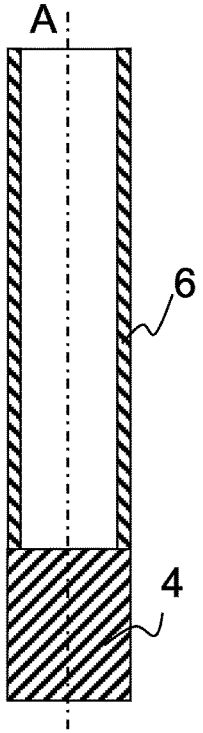
Figure 1C:
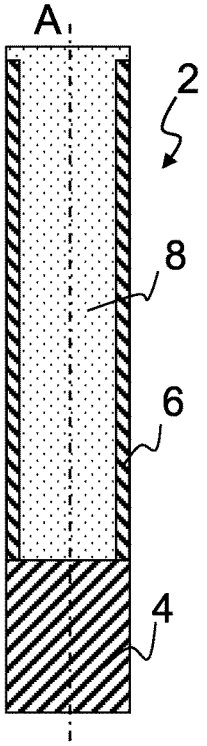

FIGS. 1*a-c* schematically and in a sectional side view show the components of a contact pin 2 during production. The contact pin 2 is constructed from a contact tip 4, a support sleeve 6, and a support core 8.

When the contact pin 2 is used in a high-voltage switch the contact tip 4 contacts a pipe contact 10*a-b* (FIGS. 2*a-b* and 3*a-b*) so as to close the switch contact. The contact tip 4 is produced from an arc resistant or arc-erosion resistant material, respectively, such that the contact tip 4 or the contact pin 2, respectively, is not damaged by the arcs which arise during a switching procedure. For example, WCu 80/20 (Cu: 20% by weight) may be used as a contact-tip material. The contact tip 4 extends across the entire forward region of the contact pin 2 in which arcs may arise during a switching procedure. Respectively, the contact pin 4 in the axial direction A (movement direction) has an extent/length which guarantees that arcs which arise during use are limited to the contact tip 4.

The tubular support sleeve 6 is disposed so as to directly adjoin the contact tip 4 and is connected to the contact tip 4 by means of electron-beam welding, for example. The connection between the contact tip 4 and the support sleeve may preferably be established during integral-casting of the support core 8. The support sleeve 6 is disposed in a region of the contact pin 2 in which no arcs arise during use, the support sleeve 6 being disposed outside the region in which arcs may arise, respectively. Therefore, the support sleeve 6 may be produced from a material which is not arc resistant but is (only) heat resistant and resistant to hot gases which are created by virtue of the arcs during switching procedures. In particular, more cost-effective materials may be used such that the production costs of the contact pin 2 are reduced. Additionally, materials of lesser density may be used for the support sleeve 6, such that the total weight of the contact pin 2 is reduced, on account of which in turn a drive for the contact pin 2 is stressed to a lesser extent, or a more cost-effective drive having less output may be used. For example, molybdenum, tungsten, or another refractory metal, or an alloy based on a refractory metal, may be used for the support sleeve 6. A further alternative is steel which is conceived for withstanding the high temperatures (up to approx. 1000° C., for example). The support sleeve 6 may be provided as a seamless (ready-made) pipe, for example. Alternatively, a flat sheet metal may be simply bent and welded to form a pipe or a hollow cylinder, respectively.

Once the support sleeve 6 has been fastened to or even just positioned on the contact tip 4, respectively, (FIG. 1*b*), in a next step the support sleeve 6 is cast such that a support core 8 is configured in the support sleeve 6. The support core 8 is produced from a material having good electrical conductivity, for example copper, aluminum, or a respective alloy based on copper/aluminum, for example CuCr1Zr. The support core 8 having good electrical conductivity improves the electrical conductivity of the contact pin 2. By casting the support core 8 inside the sleeve 6, the sleeve 6, the contact tip 4, and the core 8 are interconnected in a stable manner. In particular, the support core 8 by way of the open end of the sleeve 6 (toward the contact tip 4) is in direct contact with the contact tip 4 such that a connection having good conductivity is provided between the tip 4 and the core 8. When a comparatively soft core material is used, the sleeve 6 stabilizes or supports the support core 8, respectively.

As can be seen in FIG. 1*c*, the support core 8 protrudes somewhat beyond the open end of the sleeve 6 so as to guarantee that the contact pin 2 may be reliably installed in a respective switch or be connected to a support (not illustrated), preferably by means of electron-beam welding. Alternatively, the core 8 terminates so as to be flush with the sleeve 6.

Figure 4:
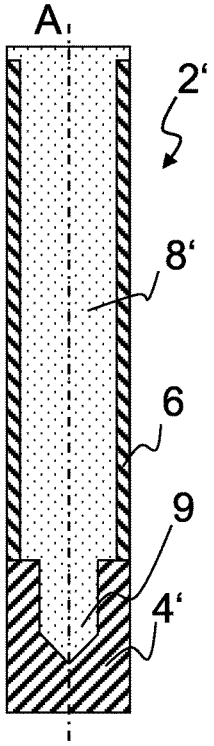
FIG. 4 shows a schematic illustration of an alternative design embodiment of a contact pin in a sectional side view.

FIG. 4 shows a schematic illustration of an alternative design embodiment of a contact pin 2'. In as far as not stated to the contrary, the function and use of the elements of the contact pin 2' which will be described hereunder correspond to those of the contact pin 2 which has been described in the context of FIGS. 1*a-c*. Identical or equivalent elements of the contact pins 2, 2' are provided with the same or equivalent reference signs, respectively.

As opposed to the contact pin 2 as has been described above, the contact pin 2' which is illustrated in FIG. 4 has a contact tip 4' having a recess 9 or a depression or bore, respectively. When a support sleeve 6 of the contact pin 2' is being effused (the former being connected to the contact tip 4', as has been described above), the recess 9' is likewise effused with the support-core material such that the support core 8' reaches into the contact tip 4'. Since the support-core material or the support core 8', respectively, is produced from a material having good (thermal) conductivity, such as copper, for example, heat dissipation from the contact tip 4' is improved by this design embodiment of the contact pin 2' such that the service life of the contact pin 2' is extended.

Figure 2A:
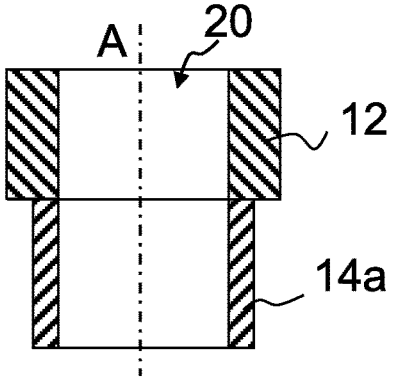
FIGS. 2*a-b* show schematic illustrations of the components of a pipe contact according to a first design embodiment, before and after infiltration and post-machining.
Figure 2B:
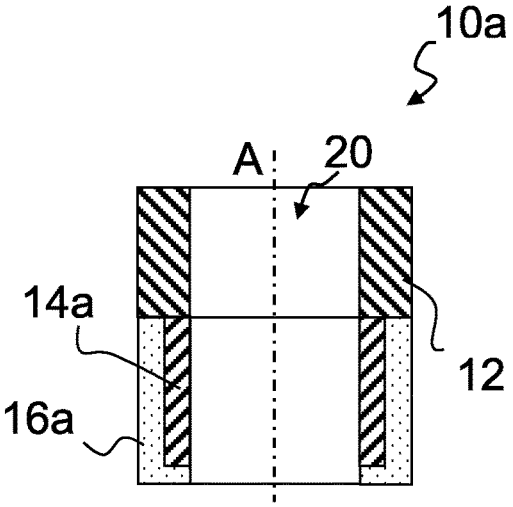

FIGS. 2*a-b* show a schematic illustration of a pipe contact 10*a* according to a first design embodiment, before and after infiltration and post-machining.

FIG. 2*a* shows the two precursor elements of the pipe contact 10*a*: an annular contact 12 having a receptacle opening 20 (for receiving the above-described contact pin 2), and a support pipe 14*a*. In an analogous manner to the description with reference to the contact pin 2, the annular contact 12 is produced from an arc resistant material and is disposed in a forward region of the pipe contact 10*a* in which arcs may arise during use. Respectively, the annular contact in the axial direction A has an extent/length which guarantees that arcs which arise during use are limited to the annular contact. In a manner which is likewise analogous to the support sleeve 6 of the contact pin 2, the support pipe 14*a*, in the case of the pipe contact 10*a*, is disposed in a region in which no arcs arise during use of the pipe contact 10*a*.

In order for the pipe contact 10*a* to be produced, the annular contact 12 and the support pipe 14*a* are mutually aligned in an axial manner or disposed on one another so as to be axially aligned, respectively. The annular contact 12 and the support pipe 14*a* are provided as sintered bodies, for example, and subsequently are collectively infiltrated with copper, for example, in an infiltration process. The annular contact 12 and the pipe 14*a* are interconnected by the collective infiltration. The excess infiltration material is removed in a subsequent subtractive machining process, the pipe contact 10*a* being imparted the final shape thereof, as is schematically illustrated in FIG. 2*b*.

In the design embodiment illustrated in FIGS. 2*a-b*, the support pipe 14*a* has a lesser wall thickness and the same internal diameter as the annular contact 12. An electrically conducting layer 16*a* remains on the external side of the support pipe 14*a* after infiltration and post-machining. As can be seen in FIG. 2*b*, the conducting layer 16*a* extends across the end edge of the support pipe 14*a* so that the pipe contact 10*a* may be reliably connected to a support (not illustrated), preferably by means of electron-beam welding. By way of infiltration, this layer 16*a* is connected in a stable manner to the annular contact 12 and the support pipe 14*a*, on account of which a pipe contact 10*a* which is extremely stable and has good electrical conductivity is provided. The support pipe 14*a*, which is exposed on the internal side, guarantees protection of the internal side of the pipe contact 10*a* from the influence of high temperatures and from hot gases, as has been described above with reference to the support sleeve 6 or the contact pin 2, respectively.

Figure 3A:
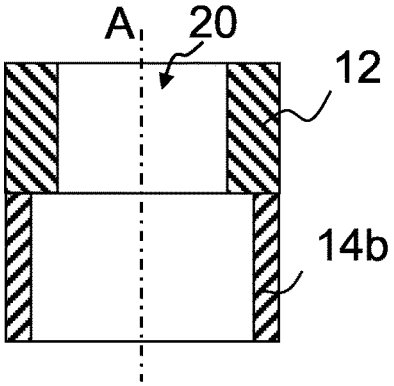
FIGS. 3*a-b* show schematic illustrations of the components of a pipe contact according to a second design embodiment, before and after infiltration and post-machining.
Figure 3B:
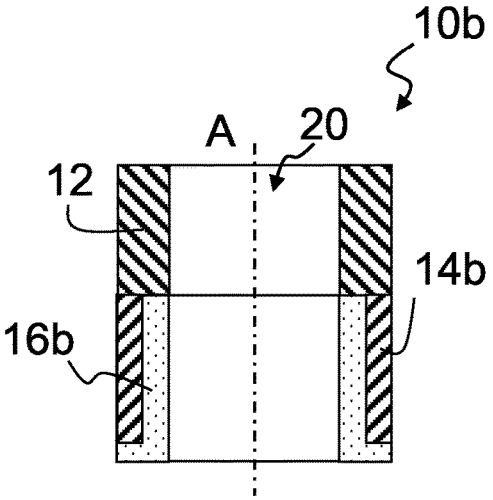

FIGS. 3*a-b* show a schematic illustration of a pipe contact 10*b* according to a second design embodiment, before and after infiltration and post-machining. In as far as not stated to the contrary, the elements, functions, and materials used correspond to those as described above with reference to FIGS. 2*a-b*.

As opposed to the first design embodiment, the support pipe 14*b* (at a lesser wall thickness) has the same external diameter as the annular contact 12. As can be seen in FIG. 2*b*, an electrically conducting layer 16*b* of the infiltration material is provided on account thereof on the internal side of the support pipe 14*b* after infiltration and subtractive machining. The support pipe 14*a*, which is exposed on the external side, guarantees protection of the external side of the pipe contact 10*a* from the influence of high temperatures and from hot gases, as has been described with reference to the support sleeve 6 or the contact pin 2, respectively.

The materials which have been described above with reference to the contact tip 4, the support sleeve 6, or the core 8, respectively, may also be used for the annular contact 12, the support pipe 14*a-b*, or the electrical conductor 16*a-b*.

LIST OF REFERENCE SIGNS

2, 2' Contact pin/pin
4, 4' Contact tip
6 Support sleeve
8, 8' Support core
9 Recess
10*a-b* Pipe contact
12 Annular contact
14*a-b* Support pipe
16*a-b* Electrical conductor/infiltration material
20 Receptacle opening
A Axis contact pin/axis pipe contact

The invention claimed is:

1. A contact pin for at least one of a high-voltage switch or a medium-voltage switch, the contact pin comprising:
- a forward region of the contact pin in which arcs arise during use of the contact pin;
- a rearward region of the contact pin in which no arcs arise during use of the contact pin, said rearward region adjoining said forward region;
- a contact tip disposed in said forward region and formed of an arc-erosion resistant material;
- a tubular support sleeve connected to said contact tip and disposed in said rearward region, said support sleeve being formed of a material selected from the group consisting of a refractory metal, an alloy based on a refractory metal and steel; and
- a support core disposed in and connected to said support sleeve.

2. The contact pin according to claim 1, wherein said contact tip is formed of a material, and said support sleeve is formed of a material having lesser density than said contact-tip material.

3. The contact pin according to claim 1, wherein said support sleeve is formed of a material, and said support core is formed of a material having lesser density than said support sleeve material.

4. The contact pin according to claim 1, wherein:
- said contact tip, said support sleeve and said support core are formed of respective materials;
- said support sleeve material has lesser density than said contact-tip material; and
- said support core material has lesser density than said support sleeve material.

5. The contact pin according to claim 1, wherein said support core has higher electrical conductivity than said support sleeve.

6. The contact pin according to claim 1, wherein said support sleeve has an external radius, and said support sleeve has a wall thickness of between 5% and 25% of said external radius.

7. The contact pin according to claim 1, wherein said support sleeve has an external radius, and said support sleeve has a wall thickness of between 15% and 18%, of said external radius.

8. The contact pin according to claim 1, wherein said contact tip is formed of at least one refractory metal or a refractory-metal alloy having a refractory-metal content by mass of 90% by weight or more.

9. The contact pin according to claim 8, wherein said at least one refractory metal is tungsten or molybdenum.

10. The contact pin according to claim 1, wherein said support core is formed of a material selected from the group consisting of copper, aluminum, an alloy based on copper or aluminum and steel.

11. The contact pin according to claim 1, wherein:
- said support core is formed of a material selected from the group consisting of copper, aluminum, an alloy based on copper or aluminum and steel.

12. The contact pin according to claim 1, wherein said support sleeve and said support core are interconnected in a materially integral manner.

13. The contact pin according to claim 1, wherein said support core is integrally cast in said support sleeve.

14. A method for producing a pipe contact, the method comprising the following steps:
- providing an arc-erosion resistant annular contact in a forward region of the pipe contact in which arcs arise during use of the pipe contact;
- providing a support pipe in a rearward region of the pipe contact in which no arcs arise during use of the pipe contact, the rearward region adjoining the forward region, the support pipe being formed of a material selected from the group consisting of a refractory metal, an alloy based on a refractory metal and steel;

axially aligning the support pipe and the annular contact;

collectively infiltrating and interconnecting the annular contact and the support pipe; and machining the interconnected annular contact and support pipe to form a receptacle opening for receiving a contact pin according to claim 1.

15. A method for producing a contact pin, the method comprising the following steps:

providing a contact tip formed of an arc-erosion resistant material in a forward region of the contact pin in which arcs arise during use of the contact pin;

providing a tubular support sleeve in a rearward region of the contact pin in which no arcs arise during use of the contact pin, the rearward region adjoining the forward region, the support sleeve being formed of a material selected from the group consisting of a refractory metal, an alloy based on a refractory metal and steel;

connecting the support sleeve to the contact tip; and providing a support core material disposed in or to be disposed in the support sleeve, forming a support core in the support sleeve.

16. A pipe contact for receiving a contact pin according to claim 1, the pipe contact comprising:

a forward region of the pipe contact in which arcs arise during use of the pipe contact;

a rearward region of the pipe contact in which no arcs arise during use of the pipe contact, said rearward region adjoining said forward region;

an arc-erosion resistant annular contact disposed in said forward region of the pipe contact; and a support pipe connected to said annular contact and disposed in said rearward region of the pipe contact, said support pipe being formed of a material selected from the group consisting of a refractory metal, an alloy based on a refractory metal and steel.

17. The pipe contact according to claim 16, wherein said support pipe has a lesser wall thickness than said annular contact, and said support pipe has an internal diameter corresponding to an internal diameter of said annular contact.

18. The pipe contact according to claim 16, wherein said support pipe has a lesser wall thickness than said annular contact, and said support pipe has an external diameter corresponding to an external diameter of said annular contact.

* * * * *